US008545577B2

(12) United States Patent
Tock et al.

(10) Patent No.: US 8,545,577 B2
(45) **Date of Patent: *Oct. 1, 2013**

(54) CATALYST COMPONENT FOR AVIATION AND JET FUELS

(75) Inventors: Richard W. Tock, Humbolt, IA (US); Arlene Hernandez, Brownfield, TX (US); James Kenneth Sanders, Lubbock, TX (US); Duck Joo Yang, Flower Mound, TX (US)

(73) Assignee: James K. and Mary A. Sanders Family LLC, Lubbock, TX (US)

( * ) Notice: Subject to any disclaimer, the term of this patent is extended or adjusted under 35 U.S.C. 154(b) by 348 days.

This patent is subject to a terminal disclaimer.

(21) Appl. No.: 12/415,053

(22) Filed: Mar. 31, 2009

(65) Prior Publication Data

US 2010/0242350 A1 Sep. 30, 2010

(51) Int. Cl.
*C10L 1/12* (2006.01)

(52) U.S. Cl.
USPC ..... 44/457; 44/357

(58) Field of Classification Search
USPC ..... 44/357, 457
See application file for complete search history.

(56) References Cited

U.S. PATENT DOCUMENTS

| | | | | |
|---|---|---|---|---|
| 5,266,082 | A * | 11/1993 | Sanders | 44/357 |
| 5,433,756 | A | 7/1995 | Gonzalez | |
| 5,525,316 | A | 6/1996 | Shustorovich et al. | |
| 5,823,758 | A | 10/1998 | Lack | |
| 5,951,722 | A | 9/1999 | Sanders et al. | |
| 6,110,237 | A | 8/2000 | Spencer et al. | |
| 6,113,660 | A | 9/2000 | Hubbard et al. | |
| 6,152,972 | A | 11/2000 | Shustorovich et al. | |
| 6,312,480 | B1 | 11/2001 | Jakob et al. | |
| 6,866,010 | B2 | 3/2005 | May | |
| 7,229,482 | B2 | 6/2007 | May | |
| 7,399,323 | B2 * | 7/2008 | Renninger et al. | 44/385 |
| 2006/0254130 | A1 | 11/2006 | Scattergood | |
| 2007/0180760 | A1 * | 8/2007 | Zhou et al. | 44/354 |
| 2009/0000186 | A1 * | 1/2009 | Sanders et al. | 44/321 |

FOREIGN PATENT DOCUMENTS

WO WO 9921942 A1 * 5/1999

OTHER PUBLICATIONS

Shell Aviation Limited, The Aeroshell Book, Eighteenth Edition, 2003, p. 34. Retrieved from the internet at <http://www.shell.com/home/content/aviation/aeroshell/technical_specifications/aeroshell_book/> on Mar. 16, 2012.*

International Search Report for International Application No. PCT/US 08/66016 dated Aug. 19, 2008.

Written Opinion of the International Searching Authority for International Application No. PCT/US 08/66016 dated Aug. 19, 2008.

* cited by examiner

*Primary Examiner* — Jim Goloboy
(74) *Attorney, Agent, or Firm* — Turocy & Watson, LLP

(57) ABSTRACT

An aviation fuel composition contains an aviation fuel and nano-sized zinc particles. Examples of nano-sized zinc particles include nano-sized metallic zinc particles, nano-sized zinc oxide particles, and nano-sized zinc peroxide particles. The aviation fuel composition can be made by combining an aviation fuel and nano-sized zinc particles. The aviation fuel composition can be used to improve combustion in an aircraft engine.

20 Claims, No Drawings

CATALYST COMPONENT FOR AVIATION AND JET FUELS

TECHNICAL FIELD

Provided are aviation fuel compositions containing nano-sized zinc particles, methods of making aviation fuel compositions, and methods of improving combustion in an aircraft engine.

BACKGROUND

Aircraft manufacturers and fuel suppliers continue to seek improved emission quality and improved fuel economy. Many aircraft engines are able to meet current emission standards using combustor technologies and theories developed over the past 50 years of engine development. However, stricter engine emission standards may not be within the capability of current combustor technologies.

Air pollution concerns worldwide have led to stricter emission standards both domestically and internationally. Aircraft emissions are governed by both Environmental Protection Agency (EPA) and International Civil Aviation Organization (ICAO) standards. These standards regulate the emission of oxides of nitrogen (NOx), unburned hydrocarbons (UHC), and carbon monoxide (CO) from aircraft engines especially in the vicinity of airports, where they contribute to urban photochemical smog problems.

In general, engine emissions fall into two classes: emissions formed as a result of high flame temperatures, such as NOx, and emissions formed as a result of low flame temperatures that do not allow the fuel-air reaction to proceed to completion, such as UHC and CO. Since different emissions are formed at different temperatures, it is difficult to mitigate simultaneously NOx, UHC, and CO.

For the fuel economy, fuels costs are a major concern for United States airline industry. In 2007, United States passenger and cargo airline operations required 19.6 billion gallons of jet fuel, or approximately 465 million barrels. The significantly increasing cost of fuel is causing the airline industry to reexam the business models upon which they operate.

SUMMARY

The following presents a simplified summary of the innovation in order to provide a basic understanding of some aspects of the innovation. This summary is not an extensive overview of the innovation. It is intended to neither identify key or critical elements of the innovation nor delineate the scope of the innovation. Rather, the sole purpose of this summary is to present some concepts of the innovation in a simplified form as a prelude to the more detailed description that is presented hereinafter.

The subject innovation provides nano-sized zinc particles that can be used to improve combustion of an aviation fuel composition in aircraft engines. One aspect of the innovation relates to an aviation fuel composition containing an aviation fuel and nano-sized zinc particles.

Another aspect of the innovation relates to methods of improving combustion of an aviation fuel composition in an aircraft engine. Yet another aspect of the innovation relates to methods of making an aviation fuel composition involving combining an aviation fuel and nano-sized zinc particles.

To the accomplishment of the foregoing and related ends, the innovation comprises the features hereinafter fully described and particularly pointed out in the claims. The following description and the annexed drawings set forth in detail certain illustrative aspects and implementations of the innovation. These are indicative, however, of but a few of the various ways in which the principles of the innovation may be employed. Other objects, advantages and novel features of the innovation will become apparent from the following detailed description of the innovation.

DETAILED DESCRIPTION

Nano-sized zinc particles are combined with an aviation fuel to improve combustion of the aviation fuel in an aircraft engine (e.g., an internal combustion engine), thereby increasing fuel economy and reducing emissions of undesirable gasses, such as $CO_2$ and $NO_x$. Examples of nano-sized zinc particles include nano-sized metallic zinc particles, nano-sized zinc oxide particles, nano-sized zinc peroxide particles, and combinations thereof. The nano-sized metallic zinc particles, nano-sized zinc oxide particles, nano-sized zinc peroxide particles, or combinations thereof are referred to herein collectively as nano-sized zinc particles.

Solid, nanometer size particles of zinc, zinc oxides, and zinc peroxides can be suspended in an aviation fuel (e.g., aviation gasoline or Avgas, and jet fuel) and can improve combustion and decrease undesirable gaseous emissions. By increasing the extent of the combustion process, better fuel economy can be achieved. The presence of the nano-sized zinc particles can act as a heterogeneous catalyst that lowers the peak combustion temperature in the combustion chambers of the aircraft engine. Lower peak combustion temperature results in a reduction in the formation of NOx. In addition, chemical reactions with the nano-sized zinc particles during the combustion process can lead to the mineralization of the carbon species, such as UHC, carbon dioxide, and carbon monoxide, and sulfur oxides formed during combustion. Mineralization converts the carbon species and sulfur oxides to solid particles (e.g., zinc salts, zinc carbonate, zincates, and zinc sulfate). Zinc salts are formed from reactions of zinc with acids (non-metal atoms) when the pH<7 while zincates are formed when the pH is >7 and zincate compounds may or may not contain other metal atoms. Mineralization reactions can provide an increase in energy output of the aircraft engine and decrease the amount of undesirable emission gases through the exhaust system.

The nano-sized zinc particles can have higher mass fractions compared to larger sized particles (e.g., micron-sized particles). As a result, the nano-sized zinc particles can remain suspended in the aviation fuel composition due to Brownian motion. Particles that are micron size and larger tend to settle out of fuel suspensions unless the suspension is continuously agitated. However, such agitation in current aircraft is uncommon and minimized in order to prevent undesirable load shifts. Nano-sized zinc particles exhibit good suspensibility without such agitation.

Compared to larger sized particles of the same mass fraction, the nano scale particles can exhibit larger total reactive surface areas, which can enhance and/or improve the combustion process. While not wishing to be bound by any theory, the inclusion of suspended nano-sized zinc particles in aviation fuel results in a decrease of surface tension characteristics of the bulk fuel, which facilitates the required phase change from aviation fuel to combustible fuel vapors. In the predominantly gas phase combustion zone, which primarily contains air mixed with a small amount of fuel vapor, the solid particles introduced with the fuel also can provide heterogeneous catalytic surfaces upon which combustion reactions occur much faster than combustion reactions without the catalytic surfaces in the homogeneous air-fuel gas phase.

In specific embodiments where nano-sized zinc oxide particles and nano-sized zinc peroxide particles are present in an aviation fuel composition, the particles can decompose or begin to sublime at the temperatures reached during combustion. Decomposition advantageously provides oxygen to fuel rich reducing regions of the combustion zone. This can contribute to more complete combustion of the aviation fuel composition.

Nano-sized zinc oxide particles and/or nano-sized zinc peroxide particles tend to be softer than nano-sized metallic zinc particles so that they can help reduce erosive wear on moving engine parts in the combustion chamber. The nano-sized zinc oxide particles and/or nano-sized zinc peroxide particles also react to facilitate preventing the buildup of more abrasive iron/carbon deposits. The non-abrasive nature of the nano-sized zinc particles is particularly important for jet engines in which turbine blades turn at high rpm values and are particularly vulnerable to erosive wear from particulate matter in the combustion gases. With piston driven airplanes, the use of soft nano-sized zinc particles can help reduce engine wear and thus represents a preventative maintenance procedure.

The aviation fuel compositions can be made by combining the nano-sized zinc particles and an aviation fuel. Aviation fuel is a specialized type of petroleum-based fuel used to power aircraft. Aviation fuel is generally of a higher quality than fuels used in less critical applications such as heating or road transport, and often contains additives to reduce the risk of icing due to low temperatures and pressures or explosion due to high temperatures, amongst other properties. Generally speaking, aviation fuels available for aircraft contain petroleum spirits used in engines with spark plugs (e.g., piston engines and Wankel rotaries) or fuel for jet engines.

Examples of aviation fuels include aviation gasoline (e.g., Avgas) and jet fuel. Avgas is a high-octane fuel used for aircraft and racing cars. Avgas is typically used in aircraft that use reciprocating or Wankel engines. Avgas generally has two numbers associated with its octane rating. Examples of this include 80/87 Avgas and 100/130 Avgas. The first number indicates the octane rating of the fuel tested to "aviation lean" standards, which is similar to the Motor Octane Number (MON) rating given to automotive gasoline. The second number indicates the octane rating of the fuel tested to the "aviation rich" standard, which tries to simulate a supercharged condition with a rich mixture, elevated temperatures, and a high manifold pressure.

Avgas has a lower and more uniform vapor pressure than automotive gasoline, which keeps it in the liquid state at high-altitude, preventing vapor lock. The high-octane ratings are typically achieved by addition of tetra-ethyl lead (TEL), a lead based anti-knock compound. The main petroleum component used in blending Avgas is alkylate, which is essentially a mixture of various isooctanes, and in some instances reformate is also employed.

Avgas is commercially available in several grades with differing maximum lead concentrations. Since TEL is a rather expensive additive, a minimum amount is typically added to the fuel to attain the required octane rating so actual concentrations are often lower than the maximum.

Examples of grades include 100LL, 82UL, 80/87, 100/130, 91/96, 115/145, and the like. 100 low lead (e.g., 100LL) contains tetra-ethyl lead, but less than highly leaded 100/130 Avgas. Most piston aircraft engines use 100LL and many airports only have 100LL. 100LL contains a maximum of 2 grams of lead per US gallon, or maximum 0.56 grams/liter and is the most commonly available and used aviation gasoline. 82UL is specification for an unleaded fuel similar to automobile gasoline but without additives. 82UL has an aviation lean octane rating (MON) of 82 or less or an antiknock index of 87 or less. Avgas 100/130 had a higher octane grade aviation gasoline, containing a maximum of 4 grams of lead per US gallon, maximum 1.12 grams/liter. Avgas typically has a density of 6.02 lb/US gallon or 0.72 kg/liter at 15 degrees Celsius.

Jet fuel is not Avgas. Jet fuel is a type of aviation fuel designed for use in aircraft powered by jet engines. A jet engine is a reaction engine that discharges a fast moving jet of fluid to generate thrust in accordance with Newton's laws of motion. Examples of jet engines include turbojets, turbofans, rockets, ramjets, pulse jets, pump-jets, and the like. In general, most jet engines are internal combustion engines. A gas turbine driven internal combustion engine (e.g., gas turbine jet engine) is an engine with a rotary compressor powered by a turbine (Brayton cycle), with the leftover power providing thrust via a propelling nozzle. These types of jet engines are primarily used by jet aircraft for long distance travel.

Civilian aircraft typically use unleaded kerosene-type jet fuels such as Jet A, Jet A1, JP-5, and JP-8, or in severely cold climates naphtha-type jet fuels such as Jet B and JP-4. The most common fuel is an unleaded/paraffin (kerosene) type fuel classified as Jet A-1 (otherwise known as AVTUR), which is produced to an internationally standardized set of specifications. Jet fuel is a mixture of a large number of different hydrocarbons, possibly as many as a thousand or more. The range of their sizes (molecular weights or carbon numbers) is restricted by the requirements for the product, for example, freezing point or smoke point. Kerosene-type jet fuel (including Jet A and Jet A-1) has a carbon number distribution between about 8 and 16 carbon numbers; naphtha-type jet fuel (including Jet B), between about 5 and 15 carbon numbers.

Both standard jet fuels (Jet A and Jet B) may contain one or more of the following additives: antioxidants to prevent gumming, usually based on alkylated phenols; antistatic agents, to dissipate static electricity and prevent sparking, e.g., dinonylnaphthylsulfonic acid (DINNSA); corrosion inhibitors; fuel System Icing Inhibitor (FSII) agents; biocide to prevent bacterial colonies inside the fuel system; and the like.

Nano-sized zinc particles are added to an aviation fuel. The nano-sized zinc particles have a size suitable to catalyze the combustion reaction of fuels, yet have 1) an ability to pass through aviation fuel filters and 2) at least substantially combust themselves, or sublime, or otherwise be consumed so that particulate emissions are minimized and/or eliminated.

In one embodiment, the nano-sized zinc particles have a size where at least about 90% by weight of the particles have a size from about 1 nm to about 200 nm. In this connection, size refers to average cross-section of a particle, such as diameter. In another embodiment, the nano-sized zinc particles have a size where at least about 90% by weight of the particles have a size from about 1 nm to about 75 nm. In yet embodiment, the nano-sized zinc particles have a size where at least about 90% by weight of the particles have a size from about 1.5 nm to about 50 nm. In still yet embodiment, the nano-sized zinc particles have a size where at least about 90% by weight of the particles have a size from about 2 nm to about 25 nm. In still yet embodiment, the nano-sized zinc particles have a size where at least about 90% by weight of the particles have a size from about 5 nm to about 20 nm. In another embodiment, about 100% by weight of the particles have any of the sizes described above, including a size of less than about 20 nm.

The nano-sized zinc particles have a surface area suitable to catalyze the combustion reaction of fuels and to increase the rate of combustion compared to using the same amount of catalyst in bulk form. Increased surface area is often better achieved via small sized particles rather than particles with high porosity. In one embodiment, the nano-sized zinc particles have a surface area from about 50 $m^2/g$ to about 1,000 $m^2/g$. In another embodiment, the nano-sized zinc particles have a surface area from about 100 $m^2/g$ to about 750 $m^2/g$. In yet another embodiment, the nano-sized zinc particles have a surface area from about 150 $m^2/g$ to about 600 $m^2/g$.

The nano-sized zinc particles have a morphology suitable to catalyze the combustion reaction of fuels, increase the rate of combustion compared to using the same amount of catalyst in bulk form, yet have an ability to pass through fuel filters. Examples of the one or more morphologies the nano-sized zinc particles may have include, spherical, substantially spherical, oval, popcorn-like, plate-like, cubic, pyramidal, cylindrical, and the like. The nano-sized zinc particles may be crystalline, partially crystalline, or amorphous.

In one embodiment, the nano-sized zinc particles do not contain health hazardous and environmentally non-friendly (by current or future standards) metals and metal oxides. For example, in one embodiment, the nano-sized zinc particles do not substantially contain lead and/or lead oxide.

Nano-sized zinc particles are commercially available from a number of sources including Sigma-Aldrich Inc. Alternatively, nano-sized zinc particles can be made by methods known in the art. For example, nano-sized zinc oxides are made by converting a zinc salt to zinc oxide. The conversion can take place in an inert atmosphere or in air via heating, such as calcining in an inert or atmospheric environment or heating in solution. In one embodiment, a zinc salt is dissolved in a liquid and subjected to ultrasound irradiation followed by its conversion to zinc oxide. Zinc peroxide particles can be made by treating the zinc oxide particles with hydrogen peroxide.

Any suitable zinc salt can be employed in the subject innovation. Examples of zinc salts include zinc chloride, zinc nitrate, zinc sulfate, zinc borate, zinc bromate, zinc chromate, and the like. In one embodiment, the nano-sized zinc particles do not substantially contain organo-zinc compounds such as organic zinc salts including zinc naphthenates, zinc acetate, and the like. While such organo-zinc compounds, which can be oxidized to zinc oxide during the combustion process, are more soluble in aviation fuels, they do not facilitate increasing solid catalytic surfaces needed to create more complete combustion. Instead such organo-zinc compounds are more likely to form complex products of incomplete combustion and/or result in undesirable engine deposits.

Any suitable liquid can be used to convert a zinc salt to a zinc oxide. Examples of liquids include water and organic solvents such as alcohols, ethers, esters, ketones, alkanes, aromatics, and the like. When using an absolute alcohol such as absolute ethanol as the liquid, the alcohol complexes with water may be liberated during the conversion process.

In one embodiment, suitable particle size distribution of the nano-sized particles is established or facilitated by sonochemistry. Sonochemistry is the science of using the acoustic energy in ultrasound to bring about physical and chemical changes. Ultrasound is broadly defined as sound having a frequency above about 18-20 kHz (the upper limit of human hearing) to about 100 MHz. Ultrasound having a frequency less than above 5 MHz can be useful for sonochemistry since it can produce cavitation in liquids, the source of chemical effects.

The sonochemical treatment can be conducted by any suitable time. In one embodiment, the sonochemical treatment is conducted during forming the nano-sized particles (e.g., when converting a zinc salt to zinc oxide). In another embodiment, the sonochemical treatment is conducted after forming the nano-sized particles. In yet another embodiment, the sonochemical treatment is conducted during and after forming the nano-sized particles.

The sonochemical treatment can be conducted by any suitable technique. In one embodiment, a zinc salt is dissolved in the liquid to provide a mixture, and the mixture is treated by ultrasound with a probe (e.g., an ultrasound horn or ultrasonic horn) that transmits ultrasound vibrations. The ultrasound horn can be immersed in the liquid where the ultrasound vibrations are transmitted directly to the mixture. In one embodiment, the sonochemical treatment forms slurry of the mixture. The sonochemical treatment can be performed in any suitable manner. For example, ultrasound vibrations are transmitted to the mixture in a batch reactor, continuous flow reactor, semi-continuous flow reactor, or the like.

The ultrasound irradiation is applied under any suitable condition to facilitate the uniformity of dispersion, duration of suspension, and/or suitable particle size distribution of the nano-sized particles. The conditions depend upon, for example, the desirable particle size distribution, constituent of the zinc salt, concentration of the zinc salt in the mixture, and the like. Examples of conditions include an intensity, a frequency, a period of time, and the like.

Any suitable intensity of ultrasound irradiation can be employed to facilitate the uniformity of dispersion, duration of suspension, and/or suitable particle size distribution of the nano-sized particles. In one embodiment, intensity of ultrasound irradiation is from about 0.005 $W/cm^2$ or more and about 50 $W/cm^2$ or less. In another embodiment, intensity of ultrasound irradiation is from about 0.01 $W/cm^2$ or more and about 10 $W/cm^2$ or less. In yet another embodiment, intensity of ultrasound irradiation is from about 0.1 $W/cm^2$ or more and about 5 $W/cm^2$ or less.

Any suitable frequency of the ultrasound can be employed. In one embodiment, a frequency is about 20 kHz or more and about 10 MHz or less. In another embodiment, a frequency is about 20 kHz or more and about 1 MHz or less. In yet another embodiment, a frequency is about 20 kHz or more and about 100 kHz or less.

The ultrasound irradiation can be contacted with the mixture for a sufficient time to facilitate suitable particle size distribution of nano-sized particles. In one embodiment, the suitable particle size distribution of nano-sized particles is formed by sonochemistry for about 1 minutes or more and about 1 hour or less. In another embodiment, the suitable particle size distribution of nano-sized particles is formed by sonochemistry for about 2 minutes or more and about 50 minutes or less. In yet another embodiment, the suitable particle size distribution of nano-sized particles is formed by sonochemistry for about 3 minutes or more and about 40 minutes or less.

In one embodiment, the ultrasound irradiation is carried out until nano-sized zinc particles have a size where at least about 90% by weight of the particles have a size from about 1 nm to about 200 nm, and then stopped. In another embodiment, the ultrasound irradiation is carried out until nano-sized zinc particles have a size where at least about 90% by weight of the particles have a size from about 1 nm to about 75 nm, and then stopped. In yet embodiment, the ultrasound irradiation is carried out until nano-sized zinc particles have a size where at least about 90% by weight of the particles have a size from about 1.5 nm to about 40 nm, and then stopped. In still yet embodiment, the ultrasound irradiation is carried out until nano-sized zinc particles have a size where at least about 90% by weight of the particles have a size from about 2 nm to about 25 nm, and then stopped. In another embodiment, the ultrasound irradiation is carried out until nano-sized zinc particles have a size where at least about 90% by weight of the particles have a size from about 5 nm to about 20 nm, and then stopped. In yet another embodiment, the ultrasound irradiation is carried out until about 100% by weight of the particles have any of the sizes described above, including a size of less than about 20 nm, and then stopped.

Methods of making zinc particles are known in the art and described in U.S. Pat. Nos. 2,563,442; 5,039,509; 5,106,608; 5,654,456; 6,179,897 (combining metal with graphite, heating to form an intermediate metal carbide, applying apply more heat to decompose the metal carbide and release the metal as a vapor, then oxidizing to form a pure metal oxide powder); PCT Publication No. WO/2007/000014; all of which are hereby incorporated by reference.

The nano-sized zinc particles (or the aviation fuel compositions or fuel additive compositions) may contain or have coated thereon one or more surfactants. Surfactants can facilitate suspending the particles within the aviation fuel composition, preventing agglomeration, promoting compatibility between the particles and aviation fuel, and the like. Any suitable surfactant can be employed including ionic surfactants, anionic surfactants, cationic surfactants, amphoteric surfactants, and nonionic surfactants. Surfactants are known in the art, and many of these surfactants are described in McCutcheon's "Volume I: Emulsifiers and Detergents", 1995, North American Edition, published by McCutcheon's Division MCP Publishing Corp., Glen Rock, N.J., and in particular, pp. 1-232 which describes a number of anionic, cationic, nonionic, and amphoteric surfactants and is hereby incorporated by reference for the disclosure in this regard.

Examples of anionic (typically based on sulfate, sulfonate or carboxylate anions) surfactants include sodium dodecyl sulfate (SDS), ammonium lauryl sulfate, and other alkyl sulfate salts, sodium laureth sulfate, also known as sodium lauryl ether sulfate (SLES), alkyl benzene sulfonate, soaps, or fatty acid salts (see acid salts).

Examples of cationic (typically based on quaternary ammonium cations) surfactants include cetyl trimethylammonium bromide (CTAB), a.k.a. hexadecyl trimethyl ammonium bromide, and other alkyltrimethylammonium salts, cetylpyridinium chloride (CPC), polyethoxylated tallow amine (POEA), benzalkonium chloride (BAC), and benzethonium chloride (BZT).

Examples of zwitterionic surfactants or amphoteric surfactants include dodecyl betaine, dodecyl dimethylamine oxide, cocamidopropyl betaine, and coco ampho glycinate.

Examples of nonionic surfactants include alkyl poly(ethylene oxide); alkyl polyglucosides, such as octyl glucoside, and decyl maltoside; fatty alcohols such as cetyl alcohol and oleyl alcohol; cocamide monoethanolamine (MEA), cocamide diethanolamine (DEA), and cocamide triethanolamine (TEA).

In one embodiment, the aviation fuel composition contains from about 0.001% to about 1% by weight of one or more surfactants. In another embodiment, the aviation fuel composition contains from about 0.01% to about 0.1% by weight of one or more surfactants.

The nano-sized zinc particles can be at least partially suspended, but typically suspended, in an aviation fuel composition in any suitable manner. The relatively small size of the nano-size particles contributes to the inherent ability to remain suspended over a longer period of time compared to relatively larger particles (larger than a micron), even though the density and/or specific gravity of the nano-size particles may be several times greater than the corresponding density and/or specific gravity of the aviation fuel. The longer suspension times mean that the aviation fuel composition containing the nano-size particles entering the engine over time contains a more uniform and/or consistent dispersion of the nano-size particles.

The nano-sized zinc particles can be present in a fuel additive composition which is combined (that is, either suspended or dispersed) with aviation fuel to make an aviation fuel composition, or present in a aviation fuel composition. A fuel additive composition provides an efficient means to store and transport the nano-sized zinc particles prior to the addition with an aviation fuel. In one embodiment, the fuel additive composition is simply a dry powder coated with one or more suitable surfactants. In another embodiment, no surfactant is used.

The powdered form may be prepared by spray drying a suspension of the nano-sized zinc particles. An inert gas such as nitrogen can be used to spray dry the particles. The coated powder can then be added to aviation fuel or an engine as a powder or made into a fuel compatible paste. The powder can be directly added into the air intake of an engine instead of adding the powder to the fuel.

The nano-sized zinc particles can be dispersed in a carrier liquid to form a fuel additive composition. The carrier liquid can be compatible with the aviation fuel. The carrier liquid can have a flash point less than 100 degrees Fahrenheit and an auto-ignition temperature less than 400 degrees Fahrenheit or is a C1-C3 alcohol. Examples of carrier liquids include one or more of toluene, xylenes, kerosene, and C1-C3 monohydric, dihydric or polyhydric aliphatic alcohols. Examples of aliphatic alcohols include methanol, ethanol, n-propanol, isopropyl alcohol, ethylene glycol, propylene glycol, and the like.

The fuel additive composition can be a combination of a carrier liquid and the nano-sized zinc particles and optionally one or more suitable surfactants. In one embodiment, the fuel additive composition contains at least about 90% by weight of a carrier liquid and no more than about 10% by weight of the nano-sized zinc particles. In another embodiment, an aviation fuel itself is used as the suspending fluid. In yet another embodiment, the fuel additive composition contains one or more surfactants that can enhance the suspension of the nano-sized particles. In still yet another embodiment, the fuel additive composition is a paste containing from about 10% by weight to about 95% by weight of the nano-sized zinc particles and from about 5% by weight to about 90% by weight of a fuel compatible organic solvent and from about 5% by weight to about 10% by weight of one or more suitable surfactants.

Some aviation fuels and fuel additives can contain relatively large or small quantities of ketones, such as acetone, or ethers, such methyl tertiary butyl ether (MTBE). A relatively large or small quantity of a ketone or ether is not necessary in the aviation fuel compositions and fuel additive compositions. In one embodiment, a relatively large quantity (more than about 5% by volume) of a ketone or ether is not present in the aviation fuel compositions and/or fuel additive compositions because ketones and ethers may decrease the solubility of the nano-sized zinc particles.

The uniformity of dispersion and/or duration of suspension can also be established or facilitated by the use of one or more suitable surfactants. Examples of such surfactants include amphoteric surfactants, ionic surfactants, and non-ionic surfactants. In one embodiment, however, the surfactant does not contain sulfur atoms. In another embodiment, the surfactant does not contain halide atoms. If employed, the surfactant can be added to the aviation fuel composition before, during, or after the nano-size particles are combined with the aviation fuel. Alternatively, the nano-size particles may be contacted or coated with the surfactant before addition to the aviation fuel. The powdered form can be prepared by spray drying a suspension of the nano-sized zinc particles containing one or more suitable surfactants. Alternatively, oven drying or vacuum drying may be employed to form the surfactant coated particles. To be safe during spray drying, an inert gas such as nitrogen can be used to spray dry the particles with surfactant.

The uniformity of dispersion and/or duration of suspension can also be established or facilitated by mixing, stirring, blending, shaking, sonicating, or otherwise agitating the aviation fuel composition containing the nano-size particles.

With time in gravitational fields, solid particles in liquid suspension generally tend to settle, or agglomerate under the influence of van der Waals' forces and settle out. Settling or sedimentation has the potential to cause ultra fine fuel filters in the aircraft to become plugged resulting in an untenable loss of fuel flow to the engine. The gravitational settling rate of solid particles in liquids is a function of; (1) the difference in specific gravities, between the particles and the suspending fluid, (2) the size and shape of the particles, and (3) the viscosity of the suspending liquid. Particle agglomeration on the other hand is due primarily to van der Waals' forces of attraction and frequency of particle-to-particle contact. Therefore, agglomeration is a direct function of both the zeta potential on the surface of the particles and particle concentration.

While the subject aviation fuel composition can contain any suitable amount of at least partially suspended nano-sized zinc particles, in one embodiment the aviation fuel composition contains less than about 280 ppm or about 0.028% by weight (expressed as zinc) of nano-sized zinc particles to prevent and/or reduce the agglomeration of the particles in the aviation fuel composition. At and below this concentration level the occurrence of particle-to-particle contact is significantly reduced.

The specific gravity of Avgas and jet fuels are essentially the same, or less than about 0.8 relative to water at 4 degrees Celsius. As shown in the following Table 1 the specific gravity for metallic zinc is higher than that of the fuel and the listed zinc compounds.

TABLE 1

| Sample | Specific Gravity (water at 4 degrees Celsius) |
|---|---|
| Avgas | less than about 0.8 |
| Jet Fuel (JP) | less than about 0.8 |
| Metallic zinc | 7.14 |
| Zinc oxide | 5.47 |
| Zinc peroxide (50%) with zinc oxide | 1.57 |

Based on the specific gravity differences shown in Table 1, all of the zinc compounds generally settle out of the fuel suspensions with metallic zinc being the first and the peroxide compound being the least likely to settle. However, if the size of the particles is reduced and maintained at a few nanometers in diameter, (e.g., d<about 50 nm), the dynamics of the suspension change, since at these small dimensions Browning motion will help maintain suspension stability. For example, nano-sized metallic zinc particles can form a quasi-stable suspension at levels of below about 10 ppm. Nano-sized zinc oxide particles can form a quasi-stable suspension at levels of below about 15 ppm. Nano-sized zinc peroxide particles can form a quasi-stable suspension at levels of below about 50 ppm. At some concentration above these concentrations, particle-to-particle collisions may eventually leads to agglomeration and partial precipitation.

In some instances, nano-sized zinc peroxide particles tend to be chemically unstable. If unsaturated hydrocarbons (olefins) are present in the Avgas or jet fuels, the presence of zinc peroxide may lead to undesirable gum formation, which would plug fuel filters and/or lead to engine deposits. Therefore, the aviation fuel composition can contain a relatively low amount of nano-sized zinc peroxide particles. In one embodiment, the aviation fuel composition contains about 0% by weight or more and about 20% by weight or less of nano-sized zinc peroxide particles based on the total zinc particles. In another embodiment, the aviation fuel composition contains about 0% by weight or more and about 15% by weight or less of nano-sized zinc peroxide particles based on the total zinc particles. In one embodiment, the aviation fuel composition contains about 0% by weight or more and about 10% by weight or less of nano-sized zinc peroxide particles based on the total zinc particles.

The aviation fuel composition contains a suitable amount of at least partially suspended nano-sized zinc particles to catalyze the combustion reaction of fuels (e.g., to improve fuel economy and/or to decrease emissions). In one embodiment, the aviation fuel composition contains an aviation fuel and from about 1 ppm to about 280 ppm (expressed as zinc) of nano-sized zinc particles. In another embodiment, the aviation fuel composition contains an aviation fuel and from about 3 ppm to about 260 ppm (expressed as zinc) of nano-sized zinc particles. In yet another embodiment, the aviation fuel composition contains an aviation fuel and from about 5 ppm to about 250 ppm (expressed as zinc) of nano-sized zinc particles. In order to meet specifications and standards for aviation gasoline and jet fuels, the aviation fuel composition may contains less than about 250 ppm (expressed as zinc) of nano-sized zinc particles. In this connection, the amount of nano-sized particles is expressed as ppm by weight of zinc contained in the nano-sized particles.

An aviation fuel composition (e.g., Avgas) for piston driven aircraft engines contains relatively low amount of nano-sized zinc particles. This is because with reciprocating piston engines a large fraction of the nano-sized zinc particles entering with the fuel is retained and increases in concentration over time within the power producing cylinders of the engine and/or because Avgas has a lower viscosity than jet fuels. In one embodiment, the aviation fuel composition for piston driven aircraft engines contains an aviation fuel and from about 1 ppm to about 60 ppm of nano-sized zinc particles. In another embodiment, the aviation fuel composition for piston driven aircraft engines contains an aviation fuel and from about 3 ppm to about 55 ppm of nano-sized zinc particles. In yet another embodiment, the aviation fuel composition for piston driven aircraft engines contains an aviation fuel and from about 5 ppm to about 50 ppm of nano-sized zinc particles.

An aviation fuel composition for jet engines contains relatively high amount of nano-sized zinc particles. This is because jet engines do not exhibit zinc accumulations in combustion chambers to the same degree as the piston driven aircraft engines, and thus the aviation fuel composition entering the combustion chamber can contain higher levels of the nano-sized zinc catalyst particles in order to achieve the desired outcome of more complete combustion. This is also because jet fuels have a higher viscosity than Avgas. In one embodiment, the aviation fuel composition for jet engines contains an aviation fuel and from about 5 ppm to about 280 ppm of nano-sized zinc particles. In another embodiment, the aviation fuel composition for jet engines contains an aviation fuel and from about 7 ppm to about 260 ppm of nano-sized zinc particles. In yet another embodiment, the aviation fuel composition for jet engines contains an aviation fuel and from about 10 ppm to about 250 ppm of nano-sized zinc particles.

The aviation fuel composition or fuel additive composition may optionally contain a bicyclic aromatic compound. Examples of bicyclic aromatic compounds include naphthalene, substituted naphthalenes, biphenyl compounds, biphenyl compound derivatives, and mixtures thereof. In one embodiment, the aviation fuel composition contains from about 0.01 ppm to about 1,000 ppm while the fuel additive composition contains from about 0.1% by weight to about 10% by weight of one or more bicyclic aromatic compounds. In another embodiment, the aviation fuel composition contains from about 0.1 ppm to about 500 ppm while the aviation fuel additive composition contains from about 0.5% by weight to about 5% by weight of one or more bicyclic aromatic compounds.

Nano-sized zinc particles can be added to bulk fuel by dilution of a pre-prepared concentrate (e.g., a fuel additive composition). In one embodiment, the fuel additive composition is made by weighing nano-sized zinc particles gravimetrically and combining them with a suspending fluid to produce the fuel additive composition containing about 32,000 ppm of zinc. If one fluid ounce of the fuel additive composition is used per 5.0 gallons of bulk fuel, then the resultant aviation fuel composition contains about 50 ppm of zinc. On a metric volume basis, 50 milliliters of the 32,000 ppm zinc additive composition treats 32 liters of fuel to produce an aviation fuel composition containing about 50 ppm of zinc.

When an aviation fuel itself contains some zinc due to processing and/or storage in metal tanks, an assay of the fuel can first be made to determine its zinc content, and then the amount of fuel additive composition to be added is adjusted to bring the final level of zinc to, for example, about 50 ppm. When the bulk aviation fuel itself is assayed and found to contain 6 ppm of zinc, then only 44 milliliters of the concentrate the 32,000 ppm zinc additive composition can be added to 32 liters of the fuel to bring it up to the desired 50 ppm. In a similar manner, if a zinc concentration of 250 ppm is desired in the same fuel, then 244 milliliters of the 32,000 ppm zinc additive composition can be added.

Because of the elevated 32,000 ppm and similar high levels of zinc in the zinc additive composition, it is likely that some of the particles precipitate over a period of twenty four hours. Therefore, where the zinc is in excess of about 250 ppm, the zinc additive composition can be agitated to re-disperse the nano-sized particles.

The aviation fuel compositions can be tailored to reduce one or more of percentages of molecular oxygen, carbon monoxide, carbon dioxide in aircraft engine exhaust emissions and to reduce one or more of parts per million of nitrogen monoxide, nitrogen dioxide, and nitrogen oxides in aircraft engine exhaust emissions. In one embodiment, the nano-sized zinc particles or the fuel additive composition is added to the aviation fuel in an amount sufficient to provide decrease of about 2% or more and about 70% or less in a percentage of carbon dioxide in aircraft engine exhaust emissions as compared to a percentage of carbon dioxide without inclusion of the nano-sized zinc particles. In another embodiment, the nano-sized zinc particles or the fuel additive composition is added to the aviation fuel in an amount sufficient to provide decrease of about 3% or more and about 60% or less in a percentage of carbon dioxide in aircraft engine exhaust emissions as compared to a percentage of carbon dioxide without inclusion of the nano-sized zinc particles. In yet another embodiment, the nano-sized zinc particles or the fuel additive composition is added to the aviation fuel in an amount sufficient to provide decrease of about 4% or more and about 55% or less in a percentage of carbon dioxide in aircraft engine exhaust emissions as compared to a percentage of carbon dioxide without inclusion of the nano-sized zinc particles.

In one embodiment, the nano-sized zinc particles or the fuel additive composition is added to the aviation fuel in an amount sufficient to provide decrease of about 1% or more and about 50% or less in parts per million of nitrogen oxides in aircraft engine exhaust emissions as compared to parts per million of nitrogen oxides without inclusion of the nano-sized zinc particles. In another embodiment, the nano-sized zinc particles or the fuel additive composition is added to the aviation fuel in an amount sufficient to provide decrease of about 2% or more and about 45% or less in parts per million of nitrogen oxides in aircraft engine exhaust emissions as compared to parts per million of nitrogen oxides without inclusion of the nano-sized zinc particles. In yet another embodiment, the nano-sized zinc particles or the fuel additive composition is added to the aviation fuel in an amount sufficient to provide decrease of about 3% or more and about 40% or less in parts per million of nitrogen oxides in aircraft engine exhaust emissions as compared to parts per million of nitrogen oxides without inclusion of the nano-sized zinc particles.

Use of the aviation fuel compositions may also result in decrease in an exhaust gas temperature and/or a cylinder head temperature. In one embodiment, the nano-sized zinc particles or the fuel additive composition is added to the aviation fuel in an amount sufficient to provide decrease of about 1 degree Fahrenheit or more and about 100 degrees Fahrenheit or less in an exhaust gas temperature and/or a cylinder head temperature as compared to that without inclusion of the nano-sized zinc particles. In another embodiment, the nano-sized zinc particles or the fuel additive composition is added to the aviation fuel in an amount sufficient to provide decrease of about 1 degree Fahrenheit or more and about 80 degrees Fahrenheit or less in an exhaust gas temperature and/or a cylinder head temperature as compared to that without inclusion of the nano-sized zinc particles. In one embodiment, the nano-sized zinc particles or the fuel additive composition is added to the aviation fuel in an amount sufficient to provide decrease of about 1 degree Fahrenheit or more and about 60 degrees Fahrenheit or less in an exhaust gas temperature and/or a cylinder head temperature as compared to that without inclusion of the nano-sized zinc particles.

The aviation fuel compositions can be also tailored to have more effective combustion thereby increasing fuel economy (e.g., fuel flow to engine (gallon per hour)). In one embodiment, the nano-sized zinc particles or the fuel additive composition is added to the aviation fuel in an amount sufficient to provide increase of fuel economy of about 1% or more and about 20% or less as compared to fuel economy without inclusion of the nano-sized zinc particles. In another embodiment, the nano-sized zinc particles or the fuel additive composition is added to the aviation fuel in an amount sufficient to provide increase of fuel economy of about 1.5% or more and about 15% or less as compared to fuel economy without inclusion of the nano-sized zinc particles. In yet another embodiment, the nano-sized zinc particles or the fuel additive composition is added to the aviation fuel in an amount sufficient to provide increase of fuel economy of about 2% or more and about 10% or less as compared to fuel economy without inclusion of the nano-sized zinc particles.

The following examples illustrate the subject innovation. Unless otherwise indicated in the following examples and elsewhere in the specification and claims, all parts and percentages are by weight, all temperatures are in degrees Fahrenheit, and pressure is at or near atmospheric pressure. Also unless otherwise indicated in the following examples and elsewhere in the specification and claims, parts per million of nano-sized zinc particles are expressed as zinc weight based on the total weight of the whole fuel composition.

Table 2 reports results of field trial with a piston engine aircraft using fuel compositions without nano-sized zinc particles and with nano-sized zinc particles. An aircraft with a six cylinder engine, model E225 manufactured by Teledyne Continental Motors, Inc. is used. The exhaust gas is analyzed using an ENERAC Model 7000 emission analyzer, manufactured by Enerac Inc. Exhaust gas temperatures, cylinder head temperatures, and fuel flow rates are monitored by on board diagnostics (OBD).

The data in Table 2 are obtained with maximum power (2,500 psig manifold pressure) of the engine at 2,250 rpm at attitude 1,500 ft. MSL. The tests are conducted using a set (uninterrupted) cruise power setting while switching from a main fuel tank without nano-sized zinc oxide particles to an auxiliary tank with nano-sized zinc oxide particles and recording readings. A minimum of two minutes or more are allowed to purge the engine after switching tanks from each other while remaining at an unchanged power for a consistent comparison.

100 Low Lead aviation gasoline without nano-sized zinc oxide particles and with nano-sized zinc oxide particles are used. While the main tank contains 100 Low Lead aviation gasoline without nano-sized zinc oxide particles, the auxiliary tank contains 100 Low Lead aviation gasoline with nano-sized zinc oxide particles. The nano-sized zinc oxide particles are present at a level from about 10 ppm to about 30 ppm as zinc and are particles having a size from 5 nm to 20 nm.

As shown in Table 2, the aviation gasoline with nano-sized zinc oxide particles advantageously exhibits decrease of 54% in $CO_2$ amount and 29.5% in NO amount in the aircraft engine exhaust emissions. The aviation gasoline with nano-sized zinc oxide particles advantageously exhibits decrease of 47 degrees Fahrenheit in the exhaust gas temperature and decrease of 40 degrees Fahrenheit in the cylinder head temperature, and increase of 9.2% in fuel economy.

TABLE 2

| Test Description | Engine Power | Air Temp. (F.) | $O_2$ (%) | CO (%) | $CO_2$ (%) | NO (ppm) | $NO_2$ (ppm) | $NO_x$ (ppm) | $SO_2$ (ppm) | Exhaust Gas Temp. (F.) | Cylinder Head Temp. (F.) | Fuel Flow (Gal. per hour) |
|---|---|---|---|---|---|---|---|---|---|---|---|---|
| Main Tank No Zn Particles | Maximum | 55 | 12.4 | 1.6 | 2.4 | 190.0 | 2.8 | 192.8 | 51.0 | 1455 | 440 | 16.3 |
| Auxiliary Tank with Zn Particles | Maximum | 56 | 10.7 | 0.83 | 1.1 | 133.8 | 2.2 | 136.0 | 44.0 | 1408 | 400 | 14.8 |

Table 3a and 3b report results of another field trial with a piston engine aircraft using fuel compositions without nano-sized zinc particles and with nano-sized zinc particles. The same aircraft, gas analyzer, and temperature monitor as Table 2 are used in the same way.

The data in Table 3a are obtained with 60% (2,000 psig manifold pressure) of the maximum power of the engine at 1,900 rpm at attitude 1,500 ft. MSL. The data in Table 3b are obtained with maximum power (2,350 psig manifold pressure) of the engine at 2,100 rpm at attitude 1,500 ft. MSL.

While the main tank contains 100 Low Lead aviation gasoline without nano-sized zinc oxide particles, the auxiliary tank contains 100 Low Lead aviation gasoline with nano-sized zinc oxide particles. The nano-sized zinc oxide particles are present at a level from about 10 ppm to about 30 ppm as zinc and are particles having a size from 5 nm to 20 nm.

In Table 3a, the aviation gasoline with nano-sized zinc oxide particles advantageously exhibits decrease of 9% in $CO_2$ amount and 12% in NO amount in the aircraft engine exhaust emissions. The aviation gasoline with nano-sized zinc oxide particles advantageously exhibits decrease of 30 degrees Fahrenheit in the exhaust gas temperature and increase of 2% in fuel economy.

In Table 3b, the aviation gasoline with nano-sized zinc oxide particles advantageously exhibits decrease of 15% in $CO_2$ amount and 26% in NO amount in the aircraft engine exhaust emissions. The aviation gasoline with nano-sized zinc oxide particles advantageously exhibits decrease of 30 degrees Fahrenheit in the exhaust gas temperature and decrease of 31 degrees Fahrenheit in the cylinder head temperature, and increase of 8.3% in fuel economy.

TABLE 3a

| Test Description | Engine Power | Air Temp. (F.) | Air Humidity (%) | $O_2$ (%) | CO (%) | $CO_2$ (%) | NO (ppm) | $NO_2$ (ppm) | $NO_x$ (ppm) | $SO_2$ (ppm) | Exhaust Gas Temp. (F.) | Cylinder Head Temp. (F.) | Fuel Flow (Gal. per hour) |
|---|---|---|---|---|---|---|---|---|---|---|---|---|---|
| Main Tank No Zn Particles | 60% | 51 | 60 | 8.6 | 5.03 | 5.5 | 262.2 | 31.5 | 293.8 | 985.0 | 1290 | 475 | 9.9 |
| Auxiliary Tank with Zn Particles | 60% | 52 | 60 | 8.7 | 5.7 | 5.0 | 237.8 | 22.2 | 260.1 | 908.8 | 1260 | 474 | 9.7 |

TABLE 3b

| Test Description | Engine Power | Air Temp. (F.) | Air Humidity (%) | $O_2$ (%) | CO (%) | $CO_2$ (%) | NO (ppm) | $NO_2$ (ppm) | $NO_x$ (ppm) | $SO_2$ (ppm) | Exhaust Gas Temp. (F.) | Cylinder Head Temp. (F.) | Fuel Flow (Gal. per hour) |
|---|---|---|---|---|---|---|---|---|---|---|---|---|---|
| Main Tank No Zn Particles | Maximum | 65 | 70 | 9.9 | 1.8 | 2.7 | 325.0 | 19.0 | 344.1 | 676.6 | 1470 | 431 | 15.6 |
| Auxiliary Tank with Zn Particles | Maximum | 66 | 70 | 10.4 | 0.85 | 2.3 | 235.0 | 20.2 | 255.2 | 512.6 | 1460 | 400 | 14.3 |

Tables 4a and 4b report results of another field trial with a piston engine aircraft using fuel compositions without nano-sized zinc particles and with nano-sized zinc particles. An aircraft with a four cylinder engine, model 320 (160 hp) manufactured by Lycoming engines is used. The same gas analyzer and temperature monitor as Table 2 are used in the same way.

The data in Table 4a are obtained with 75% (2,200 psig manifold pressure) of the maximum power of the engine at 2,500 rpm at attitude 3,000 ft. MSL. The data in Table 4b are obtained with maximum power (2,500 psig manifold pressure) of the engine at 2,750 rpm at attitude 3,000 ft. MSL.

A main tank contains 100 Low Lead aviation gasoline without nano-sized zinc oxide particles and an auxiliary tank contains 100 Low Lead aviation gasoline with nano-sized zinc oxide particles. The nano-sized zinc oxide particles are present at a level from about 10 ppm to about 30 ppm as zinc and are particles having a size from 5 nm to 20 nm.

In Table 4a, the aviation gasoline with nano-sized zinc oxide particles advantageously exhibits decrease of 4% in $CO_2$ amount and 3% in NO amount in the aircraft engine exhaust emissions. The aviation gasoline with nano-sized zinc oxide particles advantageously exhibits decrease of 30 degrees Fahrenheit in the exhaust gas temperature and decrease of 10 degrees Fahrenheit in the cylinder head temperature, and increase of 7.5% in fuel economy.

In Table 4b, the aviation gasoline with nano-sized zinc oxide particles advantageously exhibits decrease of 13% in $CO_2$ amount and 37% in NO amount in the aircraft engine exhaust emissions. The aviation gasoline with nano-sized zinc oxide particles advantageously exhibits decrease of 50 degrees Fahrenheit in the exhaust gas temperature and decrease of 54 degrees Fahrenheit in the cylinder head temperature, and increase of 9.2% in fuel economy. As shown in Tables 4a and 4b, the degree of fuel economy and reductions in emissions are a function of the engine's throttle position. The degrees of fuel economy and reductions in emissions at the maximum engine power are more significant than those at lower throttle position.

TABLE 4a

| Test Description | Engine Power | Air Temp. (F.) | Air Humidity (%) | CO (%) | $CO_2$ (%) | NO (ppm) | $NO_2$ (ppm) | $NO_x$ (ppm) | Exhaust Gas Temp. (F.) | Cylinder Head Temp. (F.) | Fuel Flow (Gal. per hour) |
|---|---|---|---|---|---|---|---|---|---|---|---|
| Main Tank No Zn Particles | 75% | 78 | 48 | 2.1 | 2.4 | 141.9 | 2.9 | 141.9 | 1260 | 315 | 14.5 |
| Auxiliary Tank with Zn Particles | 75% | 78 | 48 | 2.0 | 2.3 | 137.2 | 0 | 137.2 | 1230 | 305 | 13.4 |

TABLE 4b

| Test Description | Engine Power | Air Temp. (F.) | Air Humidity (%) | CO (%) | $CO_2$ (%) | NO (ppm) | $NO_2$ (ppm) | $NO_x$ (ppm) | Exhaust Gas Temp. (F.) | Cylinder Head Temp. (F.) | Fuel Flow (Gal. per hour) |
|---|---|---|---|---|---|---|---|---|---|---|---|
| Main Tank No Zn Particles | Maximum | 80 | 47 | 2.1 | 5.4 | 587.1 | 7.7 | 594.8 | 1360 | 364 | 16.3 |
| Auxiliary Tank with Zn Particles | Maximum | 80 | 47 | 1.7 | 4.7 | 327.2 | 0 | 372.2 | 1310 | 310 | 14.8 |

With respect to any figure or numerical range for a given characteristic, a figure or a parameter from one range may be combined with another figure or a parameter from a different range for the same characteristic to generate a numerical range.

While the innovation has been explained in relation to certain embodiments, it is to be understood that various modifications thereof will become apparent to those skilled in the art upon reading the specification. Therefore, it is to be understood that the innovation disclosed herein is intended to cover such modifications as fall within the scope of the appended claims.

What is claimed is:

1. An aviation fuel composition comprising:

an aviation fuel selected from the group consisting of 100LL Avgas, 82UL Avgas, 80/87 Avgas, 100/130 Avgas, 91-96 Avgas, 115-145 Avgas, Jet A, Jet A1, Jet B, JP-4, JP-5, and JP-8; and from about 1 ppm to about 280 ppm (expressed as zinc) of nano-sized zinc particles, where at least about 90% by weight of the nano-sized particles have a size from about 1nm to about 50 nm, to simultaneously reduce resultant aircraft engine exhaust emissions of carbon dioxide by about 3% to about 60% and nitrogen oxides by about 3% to about 40% during combustion compared to exhaust emissions of the aviation fuel without inclusion of the nano-sized zinc particles, wherein the nano-sized zinc particles comprise nano-sized zinc peroxide particles with the proviso that the nano-sized zinc particles do not substantially contain organo-zinc compounds, and the nano-sized zinc particles comprise less than about 20% by weight of nano-sized zinc peroxide particles based on the total nano-sized zinc particles.

2. The aviation fuel composition of claim 1, wherein the aviation fuel is selected from the group consisting of 80/87, Avgas 100/130 Avgas, Jet A, and Jet B.

3. The aviation fuel composition of claim 1, wherein the aviation fuel comprises an aviation gasoline selected from the group consisting of 100LL Avgas, 82 UL Avgas, 80/87 Avgas, 100/130 Avgas, 91/96 Avgas, and 115/145 Avgas; and further comprising from about 1 ppm to about 60 ppm (expressed as zinc) of nano-sized zinc particles, where at least about 90% by weight of the nano-sized zinc particles have a size from about 1 nm to about 50 nm.

4. The aviation fuel composition of claim 1, wherein the aviation fuel comprises a jet fuel selected from the group consisting of Jet A, Jet A1, Jet B, JP-4, JP-5, and JP-8; and further comprising from about 5 ppm to about 280 ppm (expressed as zinc) of nano-sized zinc particles, where at least about 90% by weight of the nano-sized zinc particles have a size from about 1 nm to about 50 nm.

5. The aviation composition of claim 1, wherein the nano-sized zinc particles further comprise nano-sized zinc particles selected from the group consisting of nano-sized metallic zinc particles and nano-sized zinc oxide particles.

6. The aviation fuel composition of claim 1, wherein the nano-sized zinc particles comprise less than about 10% by weight of nano-sized zinc peroxide particles based on the total nano-sized zinc particles.

7. The aviation fuel composition of claim 1, wherein the nano-sized zinc particles are combined with the aviation fuel in an amount sufficient to provide a decrease of about 1 degree Fahrenheit or more and about 100 degrees Fahrenheit or less in an exhaust gas temperature and a cylinder head temperature as compared to the aviation fuel without inclusion of the nano-sized zinc particles.

8. The aviation fuel composition of claim 1, wherein at least about 90% by weight of the nano-sized zinc particles have a size from about 2 nm to about 25 nm.

9. A method of improving combustion in an aircraft engine, comprising:

providing the aircraft engine with an aviation fuel composition comprising an aviation fuel selected from the group consisting of 100LL Avgas, 82UL Avgas, 80/87 Avgas, 100/130 Avgas, 91/96 Avgas, 115/145 Avgas, Jet A, Jet A1, Jet B, JP-4, JP-5, and JP-8 and from about 1 ppm to about 280 ppm of nano-sized zinc particles, where at least about 90% by weight of the nano-sized zinc particles have a size from about 1 nm to about 50 nm to simultaneously reduce resultant aircraft engine exhaust emissions of carbon dioxide by about 3% to about 60% and nitrogen oxides by about 3% to about 40% during combustion compared to exhaust emissions of the aviation fuel without inclusion of the nano-sized zinc particles, wherein the nano-sized zinc particles comprise nano-sized zinc peroxide particles with the proviso that the nano-sized zinc particles do not substantially contain organo-zinc compounds, and the nano-sized zinc particles comprise less than about 20% by weight of nano-sized zinc peroxide particles based on the total nano-sized zinc particles.

10. The method of claim 9, wherein the aviation fuel composition comprises from about 1 ppm to about 60 ppm (expressed as zinc) of nano-sized zinc particles, where at least about 90% by weight of the nano-sized zinc particles have a size from about 5 nm to about 20 nm, wherein the aviation fuel comprises an aviation gasoline.

11. The method of claim 9, wherein the aviation fuel composition comprises from about 5 ppm to about 280 ppm (expressed as zinc) of nano-sized zinc particles, where at least about 90% by weight of the nano-sized zinc particles have a size from about 5 nm to about 20 nm, wherein the aviation fuel comprises a jet fuel.

12. The method of claim 9, wherein the nano-sized zinc particles further comprise nano-sized zinc particles selected from the group consisting of nano-sized metallic zinc particles and nano-sized zinc oxide particles.

13. The method of claim 9, wherein the nano-sized zinc particles comprises less than about 10% by weight of nano-sized zinc peroxide particles based on the total nano-sized zinc particles.

14. A method of making an aviation fuel composition, comprising:

combining an aviation fuel selected from the group consisting of 100LL Avgas, 82UL Avgas, 80/87 Avgas, 100/130 Avgas, 91/96 Avgas, 115/145 Avgas, Jet A, Jet A 1, Jet B, JP-4, JP-5, and JP-8 and from about 1 ppm to about 280 ppm of nano-sized zinc particles, where at least about 90% by weight of the nano-sized zinc particles have a size from about 1 nm to about 50 nm to simultaneously reduce resultant aircraft engine exhaust emissions of carbon dioxide by about 3% to about 60% and nitrogen oxides by about 3% to about 40% during combustion compared to exhaust emissions of the aviation fuel without inclusion of the nano-sized zinc particles, wherein the nano-sized zinc particles comprise nano-sized zinc peroxide particles with the proviso that the nano-sized zinc particles do not substantially contain organo-zinc compounds, and the nano-sized zinc particles comprise less than about 20% by weight of nano-sized zinc peroxide particles based on the total nano-sized zinc particles.

15. The method of claim 14, wherein the nano-sized zinc particles are combined with the aviation fuel in an amount sufficient to provide decrease of about 1 degree Fahrenheit or more and about 100 degrees Fahrenheit or less in an exhaust gas temperature and a cylinder head temperature as compared to the aviation fuel without inclusion of the nano-sized zinc particles.

16. The method of claim 14, wherein at least about 90% by weight of the nano-sized zinc particles have a size from about 5 nm to about 20 nm.

17. The method of claim 14, wherein the nano-sized zinc particles comprise nano-sized zinc particles selected from the group consisting of nano-sized metallic zinc particles and nano-sized zinc oxide particles.

18. The method of claim 14, wherein the nano-sized zinc particles comprises less than about 10% by weight of nano-sized zinc peroxide particles based on the total nano-sized zinc particles.

19. The aviation fuel composition of claim 1, wherein the from about 1 ppm to about 280 ppm (expressed as zinc) of nano-sized zinc particles facilitate the effectiveness of combustion of the aviation fuel composition compared to the effectiveness of combustion of the aviation fuel without inclusion of the nano-sized zinc particles.

20. The aviation fuel composition of claim 1, wherein the from about 1 ppm to about 280 ppm (expressed as zinc) of nano-sized zinc particles facilitate and increase in fuel economy from about 2% to about 10% compared with fuel economy of the aviation fuel without inclusion of the nano-sized zinc particles.

* * * * *